United States Patent [19]

Roberts et al.

[11] 4,037,725

[45] July 26, 1977

[54] LAUNDRY SORTING MACHINE

[76] Inventors: Harold G. Roberts, 5905 Jimson Lane; Robert J. Brooks, 3001 N. Deer Track Road, both of Tucson, Ariz. 85702

[21] Appl. No.: 649,932

[22] Filed: Jan. 19, 1976

[51] Int. Cl.[2] ..... B07C 7/00

[52] U.S. Cl. ..... 209/122; 198/570

[58] Field of Search ..... 209/122, 123, 124, 125; 198/75, 20 T, 570; 214/1 L

[56] References Cited

U.S. PATENT DOCUMENTS

| | | | |
|---|---|---|---|
| 1,440,204 | 12/1922 | Alschuler | 209/123 |
| 2,045,351 | 6/1936 | Hanney | 209/123 |
| 3,327,942 | 6/1967 | Blume | 209/122 X |
| 3,415,372 | 12/1968 | Drace | 209/124 |

*Primary Examiner*—Robert B. Reeves
*Assistant Examiner*—Joseph J. Rolla
*Attorney, Agent, or Firm*—Dowell & Dowell

[57] ABSTRACT

A laundry sorting and counting machine comprising alternating upper and lower multiple-lane conveyor modules, arranged and sloped such that the input ends of the conveyors are clustered closer together at two different elevations but the output ends of the conveyors are spread out at a constant elevation, the conveyor modules being separately driven so that each module is a complete unit in itself, and the conveyor lanes being provided with electronic item counter and totalizer systems and with alarms and indicators designed to inform the operators when a predetermined batch has been achieved and to avoid miscounting.

12 Claims, 8 Drawing Figures

FIG. 3.
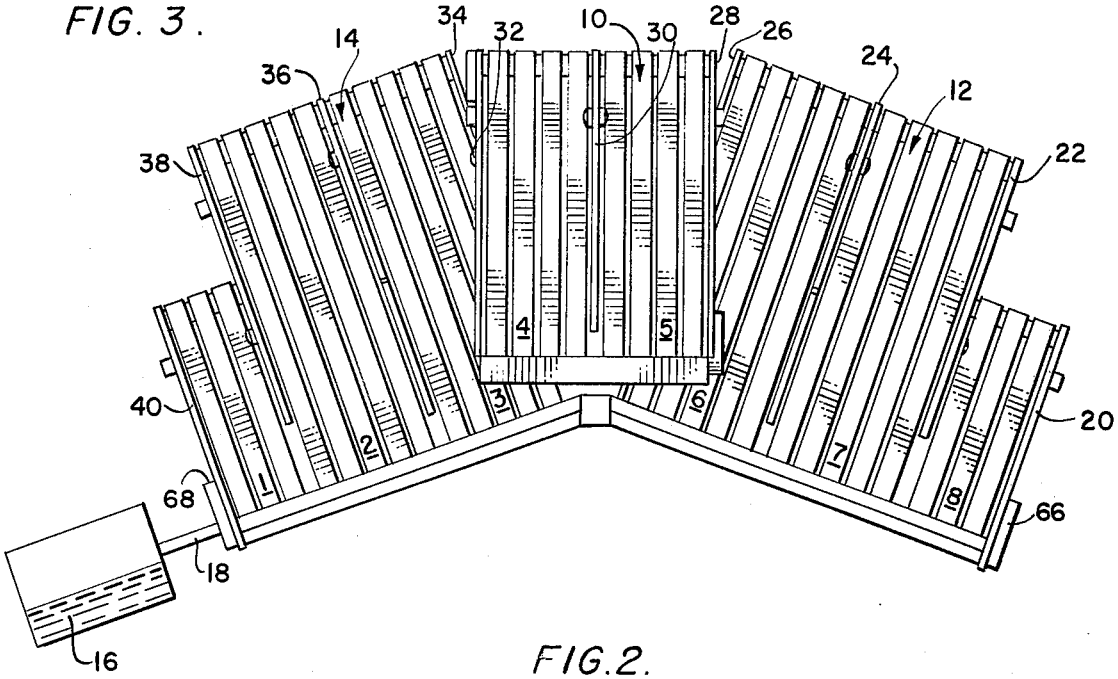
FIG. 2.
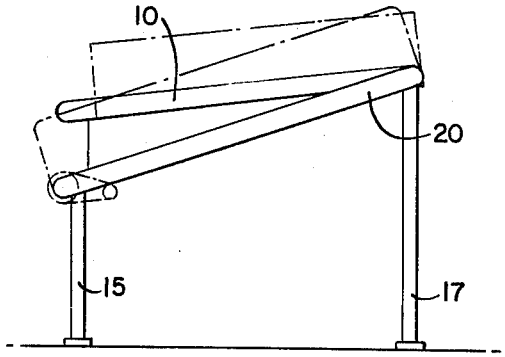
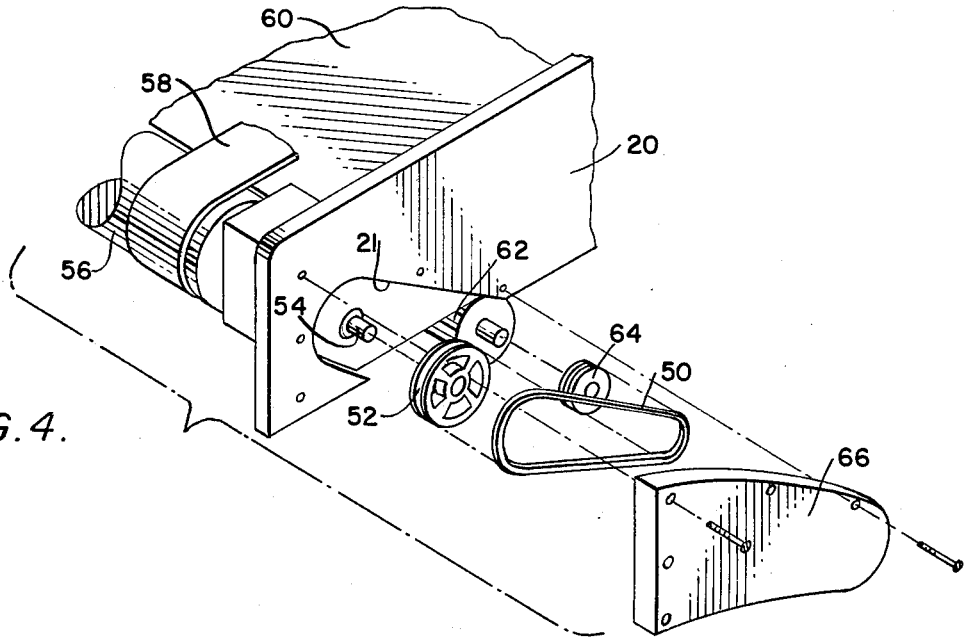
FIG. 4.

58
62
M
72
70
76
74
73
I
ADD COUNT
101
100
81
85
80
COUNT-UP
1 2 5
86
87
102
0 0 0
84
83
82
88
COUNT-UP
SUBTRACT COUNT
89
103
90
104
COUNT-UP
1 2 5
TOTAL COUNTER
91
106
COUNT-DOWN
0 2 5
DOWN COUNTER
105
110
PRESET
108
107
ZERO COUNT
109
63
76
POWER SOURCE
78
75
77

LAUNDRY SORTING MACHINE

FIELD OF INVENTION

This invention relates to machines for assisting personnel in sorting and counting laundry, and more particularly, relates to machines of the type having particular utility in commercial establishments where soiled linen is sorted by hand onto an array of conveyor belts which deliver the linen to different hampers according to type of linen, color, etc., the machine having an automatic electronic counting capability.

BACKGROUND AND PRIOR ART

The prior art includes a number of different conveyor systems for receiving soiled laundry articles sorted thereonto by hand and for delivering such items to separate hampers whose items are then delivered to appropriate washing machines. Machines of this type are shown in U.S. Pat. Nos. 3,139,965 to Eggert, 3,327,942 to Blume, 3,415,372 to Drace and 3,550,772 to Melvin. Of these references, U.S. Pat. Nos. 3,139,965 and 3,327,942 show apparatus which is very spread-out and occupies a very large amount of floor space considering the fact that each machine sorts the laundry into only three conveyor runs and therefore only three hampers. Sorting into each a small number of classifications would not be of much practical use in a commercial laundry. U.S. Pat. No. 3,550,772 does not provide conveyor-type sorting, but instead employs hand sorting into circular bins whose bottoms can subsequently open at a time onto an adjustable-position conveyor which transports the contents of each bin, one at a time, into hamper trucks as the operator may direct. Failure to sort directly onto separate conveyors deprives the machine of accurate single-piece counting and severly limits its utility. U.S. Pat. No. 3,415,372 provides for manual sorting from an input conveyor directly onto multiple output conveyors which count items and discharges them directly into hampers. It is therefore of the general type on which the present invention seeks to improve.

THE INVENTION

The laundry sorting and counting machine according to the present invention seeks to provide improvement over the prior art, especially in three different areas, namely: More efficient utilization of floor space; greater versatility be providing a machine of modular design in which two different types of modules can be assembled to provide a machine having any desired number of laundry classifying conveyor lanes; and a machine which is more convenient to use and reduces the fatigue of the operators using it.

It is a principal object of the present invention to provide a laundry sorting machine having a desired number of conveyor lanes each of which is used to classify a different laundry article, each lane discharging into a separate hamper truck located at the end of the lane. More particularly, it is the object of this invention to provide a machine in which the discharge ends of the conveyor lanes are all substantially at the same elevation, namely, an elevation which is convenient to receive a laundry hamper truck, and in which the discharge ends of the lanes are sufficiently fanned out that a hamper can be placed at the end of each lane without interfering with the placement of hampers at adjacent lanes.

It is another major object of the invention to provide a laundry sorting machine in which the input ends of the lanes, whereat the operators sort the linen and toss the various articles onto the appropriate conveyors, are stacked in overlapping relationship which is conveniently designed to make access to the input of each lane convenient, but in which all of the inputs of the lanes are brought closer together to reduce the tendency of the operator to have to walk back and forth during sorting, as is necessary where the input ends of the lanes are all on the same level and disposed side by side, so that the input end of the machine occupies a relatively great distance from the first lane to the last lane. By appropriately staggering and overlapping the input ends of the lanes, the present disclosure has provided a more compact machine without loss of convenience.

It is another important object of the invention to provide the lower conveyor lanes with a greater upward rise along the course of the conveyor, and to provide the upper conveyor lanes with a lesser rise along their courses, whereby the discharge ends of the lanes may all be provided at approximately the same vertical elevation off of the floor of the building.

Still another object of the invention is to provide laundry sorting conveyor means in which two different types of modules are used, the lower modules having three conveyor runs thereon, and the upper modules having two conveyor runs, and these modules being supported on a frame of legs and brackets arranged such that an upper module can be joined to and supported by two lower modules when the input ends of the lower modules are brought together, and their discharge ends are separated by a distance approximating the width of the upper two-lane conveyor modules. By this means, a number of different modular arrangements can be made to provide whatever number of total lanes is required by any particular laundry company in which the machine is installed, each of the modules having its own drive motor and belt system, whereby the modules may be selectively run or shut down depending upon the number of classifications required to sort the laundry taken in on a particular day or batch.

Another object of the invention is to provide in each module appropriate lane separators especially shaped to avoid hanging up of laundry items which may be tossed onto a lane in such a manner that part of the item overlaps the separator board next to the adjacent lane.

Another object of the invention is to provide an improved photoelectric cell counting arrangement built into the side separator boards of each lane and having the lenses for the lamps and photocells protrude from the side separator board a small distance into the conveyor lane so that the laundry items passing these lenses will occasionally brush them and thereby wipe the lint from the lenses to keep them clean.

Still another object of the invention is to provide an improved electronic counting system which includes four electronic counter readouts for each conveyor lane. Two of these counters are used alternately to count upwardly starting from zero in response to inputs from the photoelectric cells in each lane. The purpose of two counters is to permit an immediate switch to the other counter when a batch is completed, thereby to maintain uninterrupted production flow as the feeder personnel take on the next batch. The count from the 1st counter is logged while the 2nd counter is recording the succeeding batch, thereby eliminating any delay which would be caused by having to stop counting while the counter is read and logged.

The 3rd counter for a lane is a countdown counter which is preset at a particular value representing the precise production increment desired for subsequent processing. This assures the user of full utilization of other equipment such as washers, extractors and tumblers to their rated capacities. When the downcounter reaches zero, a visible and/or audible alarm signal will be set off to indicate that the receptacles should be removed and replaced in that lane. These signals include lights placed on a bar located over the tops of the conveyors, and push buttons are associated with the various lights so that the personnel at the output end of the lane can reset the counter from zero to the desired initial value after he has replaced the hamper truck in that lane. In addition, reset mechanisms may be located on the control panel to permit operators at the input end to reset the counters.

The fourth set of counters in each lane are used to totalize the total number of items passing through the lane for that particular day, shift, or batch. These counters are carried on a control panel which is mounted on a separate stand-up unit plugged into the conveyor system, and this unit having appropriate set and reset buttons to control the counters manually.

It is another object of the invention to provide a push button means at each counter which can be actuated by the operator to increase the count on a particular lane if the operator accidentally throws two items onto that lane in such a manner that they pass the photoelectric cell without tripping it twice, as for instance, when the items are mutually stacked. A visible or audible indicator can also be provided for each lane, the signal being actuated each time a counter counts an additional item in that lane, thereby showing that the system is operating properly to produce the desired totals.

Other objects and advantages of the present invention will become apparent during the following discussion of the drawings, wherein:

THE DRAWINGS

FIG. 2 is a side view of a machine according to the present invention showing the difference in inclination between the upper conveyor lanes and the lower conveyor lanes, all of which exit at approximately the same elevation from the floor;

FIG. 3 is an pan view of a machine according to the present invention;

FIG. 4 is an exploded perspective view enlarged to show a motor and belt drive means for driving a conveyor according to the present invention;

Figure 1:
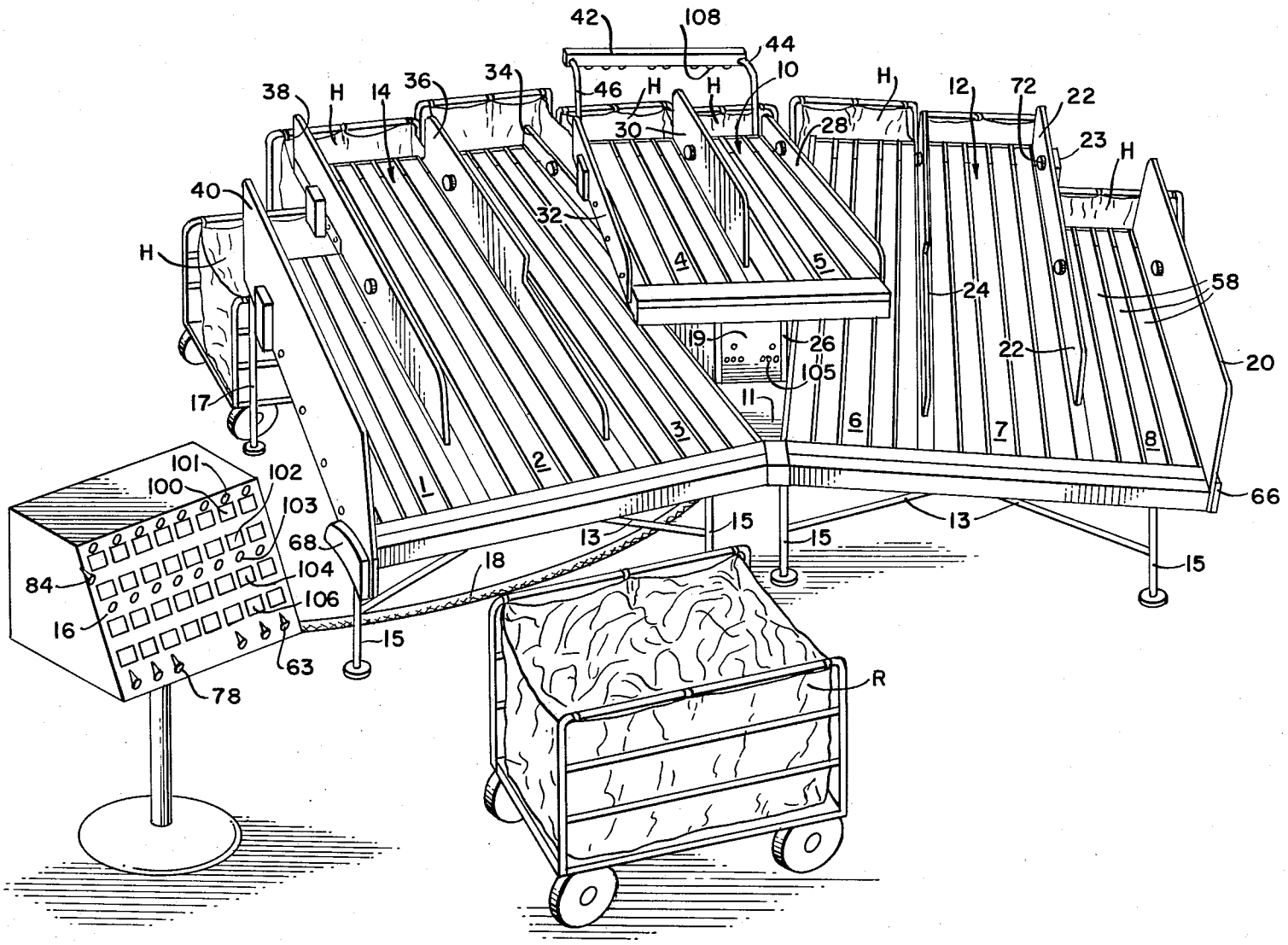
FIG. 1 is a perspective view showing a three-module conveyor system according to the present invention operatively associated with an electronic control and counter panel and showing appropriate hamper trucks feeding the conveyor system and also removing sorted items from the output ends thereof.

Referring now to the drawings, and particularly to FIGS. 1, 2, and 3, the laundry sorting machine according to the present invention comprises an upper module 10 and two lower modules 12 and 14, and the machine also includes a stand-alone electronic control panel 16 which is connected to the other units by means of cables 18. The illustrated sorting machine includes eight lanes labelled 1 through 8 inclusive, but there is no reason that other numbers of lanes could be used. It should be noted that lane No. 1 and lane No. 8 are shorter than the other lanes in the lower modules as illustrated in FIGS. 1 and 3, but lanes No. 1 and 8 could also be the same length as lanes 2, 3, 6, and 7. This would have the advantage of providing symmetrical lower units 12 and 14 which would be identical to each other, whereby the system would be made up entirely of only two different modules which could be stacked in various different organizations to produce a differing number of total lanes at each installation. The lower modules 12 and 14 have a metal frame including braces 13 and legs 15, the rears of the frames including legs 17 as well as center legs beneath the module 10, the rear end of the module fitting into brackets carried by the rear legs to which the rear of the module 10 is either bolted or pinned by passing pins through holes in the brackets. The front end of the module 10 may either rest upon the horizontal deck surface 11, or upon the top of a small electronic control indicator box 19 which will be further discussed hereinafter. Alternatively the front end of the upper module 10 can be mounted to the lower modules using its own pin and post assembly which attaches to the front inside legs 15 of the lower modules, this structure not being illustrated. The lanes of the modules are bounded by side boards 20, 22, 24, 26, 28, 30, 32, 34, 36, 38 and 40. Above the rear of the center conveyor lanes there is an indicator bar 42, see FIG. 7, supported on metal arms 44 and 46, which bar supports lamps and preset switches which will presently be described with reference to FIG. 8.

Each of the modules 10, 12 and 14 preferably has its own motor and belt drive so that it can be turned on and off as needed to accomodate a particular work load or batch. FIG. 4 shows this structure for the module 12 which includes a side board 20 which has been cut away as shown at 21 to accomodate a belt 50, a pulley 52 attached to the end of a shaft 54 which extends through the side board 20 and carries a roller 56 on which a number of belts such as the belts 58 are driven. These belts are formed by metal lacings located at the ends of a ribbon and joined to one another with a pin, and the belts pass over idler rollers located at the output end of each conveyor lane, which rollers are not illustrated in detail. Each conveyor lane comprises a deck 60 made of a hard slippery material such as formica over which the belts such as the belt 58 run. The formica 60 provides a smooth continuous deck between the individual belts 58 so that the laundry items tend to travel smoothly over the deck to the discharge end. Other appropriate stripping is used to protect the edges of the deck and make a smooth finish over which the laundry items easily slide. All of the lanes in each module are driven by the same motor, such as the motor 62 illustrated in FIG. 4, which motor drives a lower pulley 64 over which the other end of the belt passes. A protective cover 66 is used to make the machine safe for the operating personnel to use, another protective cover 68 for a different conveyor module being visible at the left end of the module 14 in FIG. 1.

Figure 5:
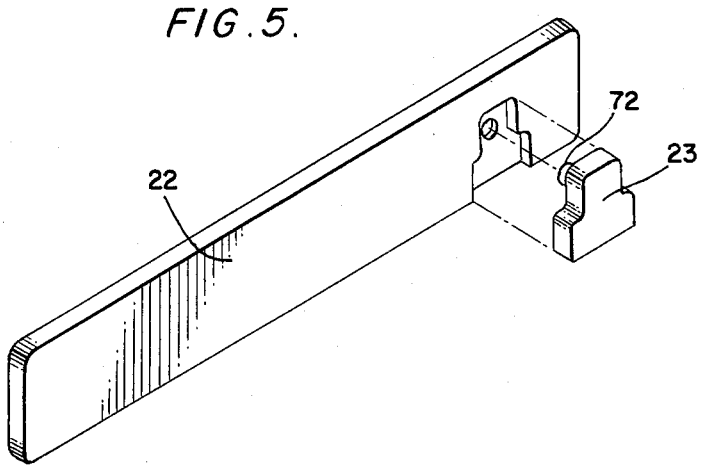
FIG. 5 is a perspective view showing a photoelectric counter unit in exploded relation with respect thereto.
Figure 6:
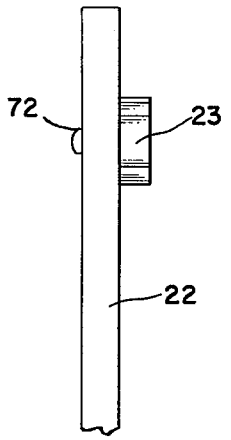
FIG. 6 is a partial pan view of a separate board showing a photoelectric unit extending therethrough and beyond the surface of the board so that laundry items passing the board on a conveyor will wipe the lens of the photoelectric cell.
Figure 8:
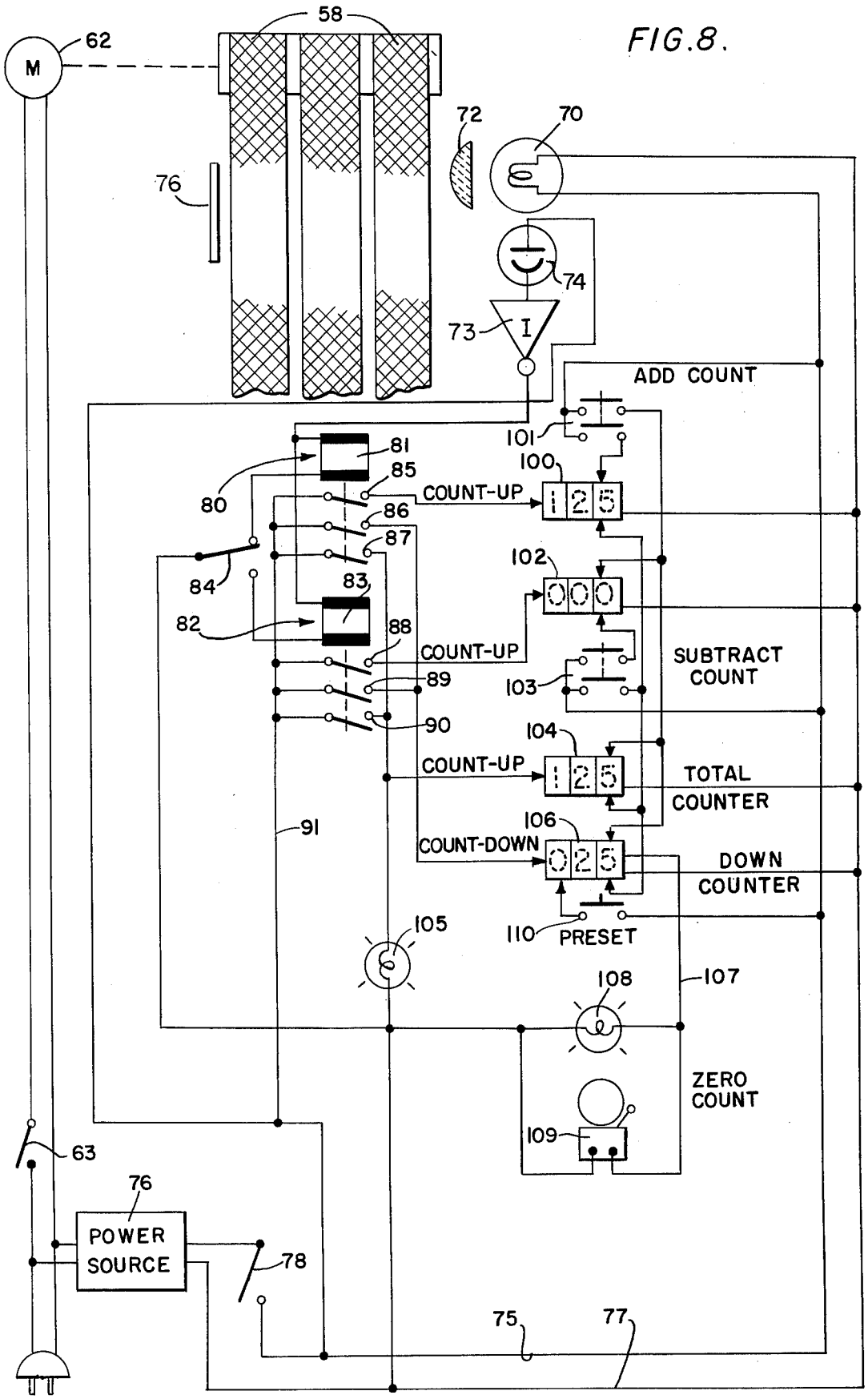
FIG. 8 is a circuit diagram showing the electrical drive, counters and controls for one typical conveyor lane.

Appropriate light sources and photoelectric cells drive the counters, FIG. 8, and are located near the output end of each conveyor lane. FIGS. 5 and 6 show a typical separator board such, for instance, as the board 22 from which protrudes the lens of a light source 23, the lens extending far enough beyond the board so as to be wiped occasionally by laundry items as they travel therepast.

As can be seen in FIG. 1, a number of hamper trucks H have been arranged at the output ends of the conveyor lanes 10, 12 and 14 to pick up the laundry items which have been sorted and counted on the conveyor. The input end of each of the conveyors is hand fed by personnel taking the soiled laundry from the receptacle R and placing it on the particular one of the conveyor lanes 1, 2, 3, 4, 5, 6, 7, or 8 on which that particular item of laundry belongs.

Figure 7:
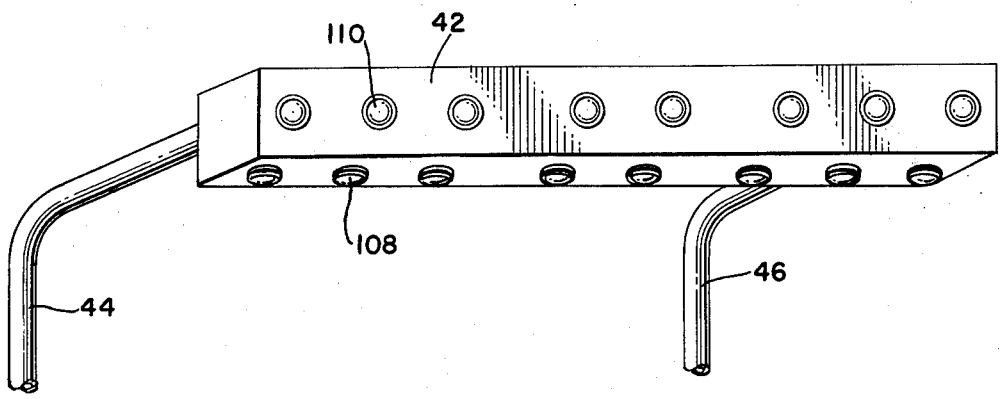
FIG. 7 is an enlarged perspective view showing a light and push button located at the output end of the conveyor system for instructing the personnel thereat when to change hamper trucks in each of the lanes.

Referring now to FIG. 8 showing the electronic counting and indicating system, the external appearance of which is shown in FIGS. 1 and 7, a typical counting system for counting items passing on the belts 58 of a conveyor lane comprises in the housing 23 a lamp 70 whose beam is focused by a lens 72 across the lane to a reflector 76 and back to photoelectric cell 74. Preferably a self contained unit housing both the lamp and the photocell is employed. The lamp 70 draws power from a power source through wires 75 and 77 through a switch 78 serving as the ON-OFF switch for the counter system at that conveyor lane.

The photoelectric cell 74 is normally illuminated by the lamp 70 and is thus normally rendered conductive. Due to the inverter 73, neither of the upper terminals of the relay windings 81 and 83 of the relays 80 and 82 is normally energized. The other terminals of these windings 81 and 83 can be returned to the other side 77 of the power lines 75 and 77 through a manual selector switch 84, but only one winding at a time. Therefore, the operator can select one of the two relays at a time using the switch 84. When the light beam is broken, the selected relay 80 or 82 is then energized by the inverter 73.

There are four counters for each lane respectively performing the functions set forth above. The counters 100 and 102 serve alternately, depending upon the position of the selector switch 84, to count items passing on the conveyor belts 58. The counter 104 totalizes the items being counted by the counters 100 and 102 without being reset as often as the latter. The counter 106 is a down-counter capable of having an initial count preset thereinto from which it counts down toward zero as the various items pass the photoelectric cell 74 on the conveyor, as will be presently explained.

For example, if relay 80 is selected by placing switch 84 in a first position, then each time an item passes along the conveyor and interrupts the light beam to the photoelectric cell 74, inverter 73 delivers a pulse of current to relay winding 81 closing all three contacts 85, 86 and 87. The current flowing from the wire 91 through contact 85 energizes the count-up terminal of counter 100. Conversely, if the switch 84 were in a second position, so that the photoelectric cell 74, via inverter 73, energizes coil winding 83 of relay 82, all three contacts 88, 89 and 90 would be closed and current would flow through wire 91 through contact 88 to the count-up terminal of counter 102.

Each time one of the relay windings 81 or 83 is energized by the photoelectric cell 74 through inverter 73, either contact 87 or contact 90 delivers current to the count-up terminal of the total counter 104, which counter tallies the total number of items being counted by the counters 100 and 102. Closing of contacts 87 or 90 also energizes light 105 to provide a visible indication of each count.

Moreover, each time one of the relay windings 81 or 83 is energized by the photoelectric cell 74 through inverter 73, either contact 86 or 88 delivers current to the count down terminal of the down counter 106 reducing its preset count by one. When the down counter 106 reaches zero count, it delivers a current output into wire 107 to energize light 108 and ring bell 109. The down counter 106 can be manually set to a predetermined value using preset switch 110. Light 108 and the preset switch 110 are carried by bar 72 (see FIG. 7) for each lane, and bell 109 can be mounted in the bar to attract the attention of the operator when light 108 is ON.

Each of counters 100, 102 and 104 are provided with manual reset to zero controls (not illustrated) to improve the flexibilty of the system. Counter 106 is electrically reset from bar 42 or manually reset at the counter itself.

An add count switch 101 and a substract count 103 switch are connected to counters 100 and 102 in such a manner that for whichever counter 100 or 102 is active at any moment, the operator can manually add or subtract a count if, for instance, too many or too few items have actually been tallied by the counters.

The operation of the system will be discussed with reference to lane 7, shown in FIG. 1, as the circuitry of FIG. 8 refers to that lane. Lane 7 may, for instance, be the lane in which towels are sorted. At the beginning of a run to count a bundle of towels in hamper R, counters 100, 102 and 104 are set to zero and counter 106 is preset to a particular number of towels which can be accomodated by hamper H at the output end of lane 7. As an operator at the input end of lane 7 feeds laundry thereonto, the light beam is interrupted by each passing towel. Relay 80 or 82, whichever is selected by switch 84, momentarily closes upon interruption of the light beam. Assuming relay 80 to have been selected, counter 100 and the total counter 104 will be advanced one count, counter 106 will be reduced by one count and counter 102 will remain dormant during passage of each towel. For example, in FIG. 8 the counters 100 and 104 indicate 125; if the down counter were initially preset to indicate 150 and now indicates 025, it means that 25 more towels are to be counted in that batch before hamper H at the end of lane 7 should be replaced. When a zero count is reached on counter 106, light 108 and bell 109 are energized to indicate that hamper H is filled. The filled hamper is replaced with an empty one and counter 106 is reset. When a new batch of laundry is to be counted, switch 84 may be reversed so that further items sorted onto lane 7 are counted by counters 102, 104 and 106.

Counter 100 or counter 102 can be used to count batches headed for a particular washing machine for instance, while the total counter counts all towels coming either from a large customer, or even total towels received from all customers. Moreover, to let the laundry personnel know that the counters are actually being actuated, a light for each lane is illuminated on control panel 19 each time an item in a lane interrupts the light beam. If an operator accidently trips a counter only once by sending through two stacked towels, or by interrupting the light beam with his hand when no towel passed, the faulty count can be corrected by using add count switch 101 or subtract count switch 103, as may be appropriate; these switches are located on control panel 16 along with counters 100, 101, 102, 103, 104, 106, the selector switch 84, a conveyor motor control switch 63 for each module and ON-OFF switch 78 controlling the counting system.

Where, because of expense or mechanical and electrical complexity, and/subtract counters may not be feasible, a skip count switch may be incorporated. Such a switch, upon manual actuation, momentarily disables the active counter(s), whether up or down counters, to permit correction of an over or under count by inhibiting registration of the passage of one or more subsequently conveyed items of laundry.

Control components illustrated and described with respect to FIG. 8 may be electromechanical, or they may be electrical. Moreover, analog, digital or hybrid circuitry may be employed as dictated by matters of size, expense and complexity.

While the principles of the invention have now been made clear in an illustrative embodiment, there will be immediately obvious to those skilled in the art many modifications of structure, arrangement, proportions, elements, materials, components, used in the practice of the invention which are particularly adapted for specific environments and operating requirements without departing from those principles.

We claim:

1. Apparatus for delivering segregated items of laundry from a sorting area into a corresponding one of a plurality of hampers within a discharge area, said apparatus comprising in combination:

a. a plurality of first conveyor means for conveying the items of laundry, said plurality of first conveyor means defining a fan like pattern from the sorting area to the discharge area, each of said first conveyor means including an input end disposed in proximity to the sorting area for receiving sorted items of laundry and located at a first level and including an output end disposed in proximity to the discharge area at a common discharge level for discharging the items of laundry into the hampers located therebelow, the input ends being close together and some of the output ends being separated to provide a space between the separated output ends of the first conveyor means in the fan like pattern;

b. a plurality of second conveyor means for conveying further items of laundry, said plurality of second conveyor means extending from the sorting area to the discharge area, each of said second conveyor means including an input end disposed in proximity to the sorting area for receiving sorted further items of laundry and located at a second level upwardly displaced from the first level and partially overlapping said closely spaced input ends of the first conveyor means and further including an output end disposed in a space between separated output ends of the first conveyor means at said common discharge level, the output ends of the second conveyor means in general horizontal alignment with the output ends of said plurality of first conveyor means for discharging the further items of laundry into the hampers; and c. drive means for driving said plurality of first and second conveyor means;

d. whereby an operator within the sorting area has ready access to the input ends of said plurality of first and second conveyor means and the output ends thereof are sufficiently laterally displaced to accommodate placement of hampers in proximity thereto.

2. The apparatus as set forth in claim 1, wherein said plurality of first conveyor means slope upwardly from the sorting area to the discharge area and said plurality of second conveyor means slope upwardly from the sorting area to the discharge area at an angle less steep than the angle of slope of said plurality of first conveyor means.

3. The apparatus as set forth in claim 1, wherein each conveyor means of said plurality of first and second conveyor means comprises:

a. a conveyor belt for transporting items of laundry;

b. a side board disposed at each side of said conveyor belt for inhibiting lateral movement of the conveyed items of laundry;

c. photoelectric sensor means for sensing passage of items of laundry along said conveyor means and generating a signal responsive thereto; and d. counters for recording the number of signals generated by said sensor means and maintaining a tally of the number of times of laundry conveyed.

4. The apparatus as set forth in claim 3, including settable counters for generating a signal upon completion of a predetermined count representative of a full load.

5. The apparatus as set forth in claim 4, including an indicator bar mounted at the output ends of selected ones of said plurality of first and second conveyor means, each said indicator bar including signalling devices responsive to said counters for indicating the conveyance of a predetermined count of items of laundry by the respective one of said conveyor means.

6. The apparatus as set forth in claim 4, including control means disposed in proximity to the sorting area and operative for monitoring and regulating the operation of said plurality of first conveyor means and said plurality of second conveyor means.

7. The apparatus as set forth in claim 6, wherein said control means comprises:

a. switch means for selectively energizing said plurality of first and second conveyor means;

b. means for recording the number of items conveyed by each conveyor means of said plurality of first and second conveyor means;

c. further switch means for amending the registered count of said counters and said settable counters; and d. means for providing visible indications of the number of items of laundry conveyed by each of said plurality of first conveyor means and of the number of further items of laundry conveyed by each said plurality of second conveyor means.

8. The apparatus as set forth in claim 7, wherein said sensor means are carried by said side boards and include lens means facing said conveyor means and protecting said sensor means from an accumulation of foreign matter, said lens means extending into the path of the conveyed items of laundry, whereby said lens means is repetitively wiped to clean the surface of said lens means.

9. The apparatus as set forth in claim 8, wherein said drive means comprises:

a. first drive means for driving said plurality of first conveyor means; and b. second drive means for driving said plurality of second conveyor means, said first and second drive means being independently operable through said control means.

10. Apparatus for delivering segregated items of laundry from a sorting area into a corresponding one of a plurality of hampers within a discharge area, said apparatus comprising in combination:

a. a plurality of first conveyor means for conveying the items of laundry, said plurality of first conveyor means comprising a first module having a plurality of conveyors oriented parallel to one another and a second module having a plurality of conveyors oriented parallel to one another, said first module being angularly displaced from said second module to define a fan-like pattern from the sorting area to the discharge area, each said conveyor of the first and second modules including an input end disposed in proximity to the sorting area for receiving sorted items of laundry and located at a first level and including an output end disposed in proximity to the discharge area for discharging the items of laundry into the hampers;

a plurality of second conveyor means for conveying further items of laundry, said plurality of second conveyor means comprising a third module having a plurality of conveyors oriented parallel to one another and extending from the sorting area to the discharge area, each said conveyor of the third module including an input end disposed in proximity to the sorting area and located at a second level upwardly displaced from said first level and partially overlapping said plurality of first conveyors and including an output end disposed in general horizontal alignment with the output ends of said plurality of first conveyors for discharging the further items of laundry into the hampers;

c. the output end of said third module being disposed intermediate the output ends of said first and second modules and in general horizontal alignment therewith and the input end of said third module being vertically upwardly displaced from and laterally overlapping said first and second modules; and d. drive means for driving said plurality of first and second conveyor means;

e. whereby an operator within the sorting area has ready access to the input ends of said plurality of first and second conveyor means and the output ends thereof are sufficiently laterally displaced to accommodate placement of hampers in proximity thereto.

11. The apparatus as set forth in claim 10, wherein the input ends of said first and second modules are generally horizontally aligned in a plane vertically downwardly displaced from a horizontal plane including the output ends, and the input end of said third module is generally horizontally positioned in a plane intermediate the horizontal plane of the input ends of said first and second modules and the horizontal plane of the output ends, whereby said first and second modules slope upwardly toward the discharge area at a greater angle with respect to a horizontal plane than the slope of said third module.

12. The apparatus as set forth in claim 11, wherein said drive means comprises a first drive means for driving said first module, a second drive means for driving said second module and a third drive means for driving said third module; whereby, each of said modules is independently operable.

* * * * *